US005469410A

United States Patent [19]

Berney

[11] Patent Number: 5,469,410

[45] Date of Patent: Nov. 21, 1995

[54] WATCH WITH DATE DIAL

[75] Inventor: Jean-Claude Berney, Les Charbonnieres, Switzerland

[73] Assignee: Eta Sa Fabriques d'Ebauches, Grenchen, Switzerland

[21] Appl. No.: 211,636

[22] PCT Filed: Aug. 10, 1993

[86] PCT No.: PCT/CH93/00200

§ 371 Date: May 28, 1994

§ 102(e) Date: May 28, 1994

[87] PCT Pub. No.: WO94/03845

PCT Pub. Date: Feb. 17, 1994

[30] Foreign Application Priority Data

Aug. 10, 1992 [CH] Switzerland ..... 02492/92

[51] Int. Cl.[6] ..... G04B 19/24; G04C 3/14

[52] U.S. Cl. ..... 368/28; 368/18

[58] Field of Search ..... 368/28, 35, 37

[56] References Cited

U.S. PATENT DOCUMENTS

| | | | |
|---|---|---|---|
| 2,764,828 | 10/1956 | Wolaver . | |
| 2,976,672 | 3/1961 | Ducommun . | |
| 3,477,222 | 11/1969 | Leung et al. . | |
| 4,748,603 | 5/1988 | Ray et al. | 368/80 |
| 5,327,401 | 7/1994 | Besson et al. | 368/37 |

FOREIGN PATENT DOCUMENTS

| | | |
|---|---|---|
| 0247520 | 5/1988 | European Pat. Off. . |
| 2605118 | 4/1980 | France . |
| 2262 | 6/1890 | Switzerland . |
| 170801 | 7/1934 | Switzerland . |
| 394958 | 12/1965 | Switzerland . |

*Primary Examiner*—Vit W. Miska

*Attorney, Agent, or Firm*—Sughrue, Mion, Zinn, Macpeak & Seas

[57] ABSTRACT

A watch comprising several hands driven independently of each other by several motors, and comprising a date function whereby the date is displayed on two scales, the first for the tens and the second for the units. Specific design features also allow the month, leap year and phases of the moon to be displayed. In a specific embodiment, the hands may be replaced by graduated discs.

8 Claims, 4 Drawing Sheets

WATCH WITH DATE DIAL

BACKGROUND OF THE INVENTION

At the present time there are on the market multifunctional analog hand watches, comprising several stepping motors independently driving several gear trains. In the most simple version, two motors drive two hands, but one could also have three, four or five motors each driving one or even several hands, likewise combinations with digital displays. This is the case, for example, with the clockwork-movements 251.262 and 251.272 which have already been marketed for several years by ETA in Grenchen (Switzerland), and also the clockwork-movement disclosed in patent EP A O 247.520, corresponding to U.S. Pat. No. 4,748,603.

These configurations allow a number of additional functions, over and above classical timekeeping functions, to be displayed simultaneously or successively, for example the hours, minutes and seconds of a chronograph function.

Another of the most prevalent additional functions is without doubt the date. This date function can be simple, semi-perpetual, or perpetual. In the latter case, in addition to the date, it is necessary to program the month and leap year. Moreover, the date can be complemented by the display of the phases of the moon.

One of the principal difficulties is to display clearly the number of days in the month which can vary from 28 to 31, which presupposes, particularly in the case of an analog hand display, a special scale often difficult to read, as can be seen in the above mentioned patent.

SUMMARY OF THE INVENTION

The present invention concerns a watch with a particularly easy to read date display, this display being able to be used temporarily for the display of the month or time in a 24 hour system. This watch with a date function comprising at least several display mobiles driven completely independently of each other by at least several stepping motors is characterised in that it comprises electronic means arranged in such a way as to display the date by means of two scales placed on two distinct dials, tens being displayed on a first dial by a first of said display mobiles driven by a first motor, and units on a second dial by a second of said display mobiles driven by a second motor.

DESCRIPTION OF PREFERRED EMBODIMENTS

Figure 1:
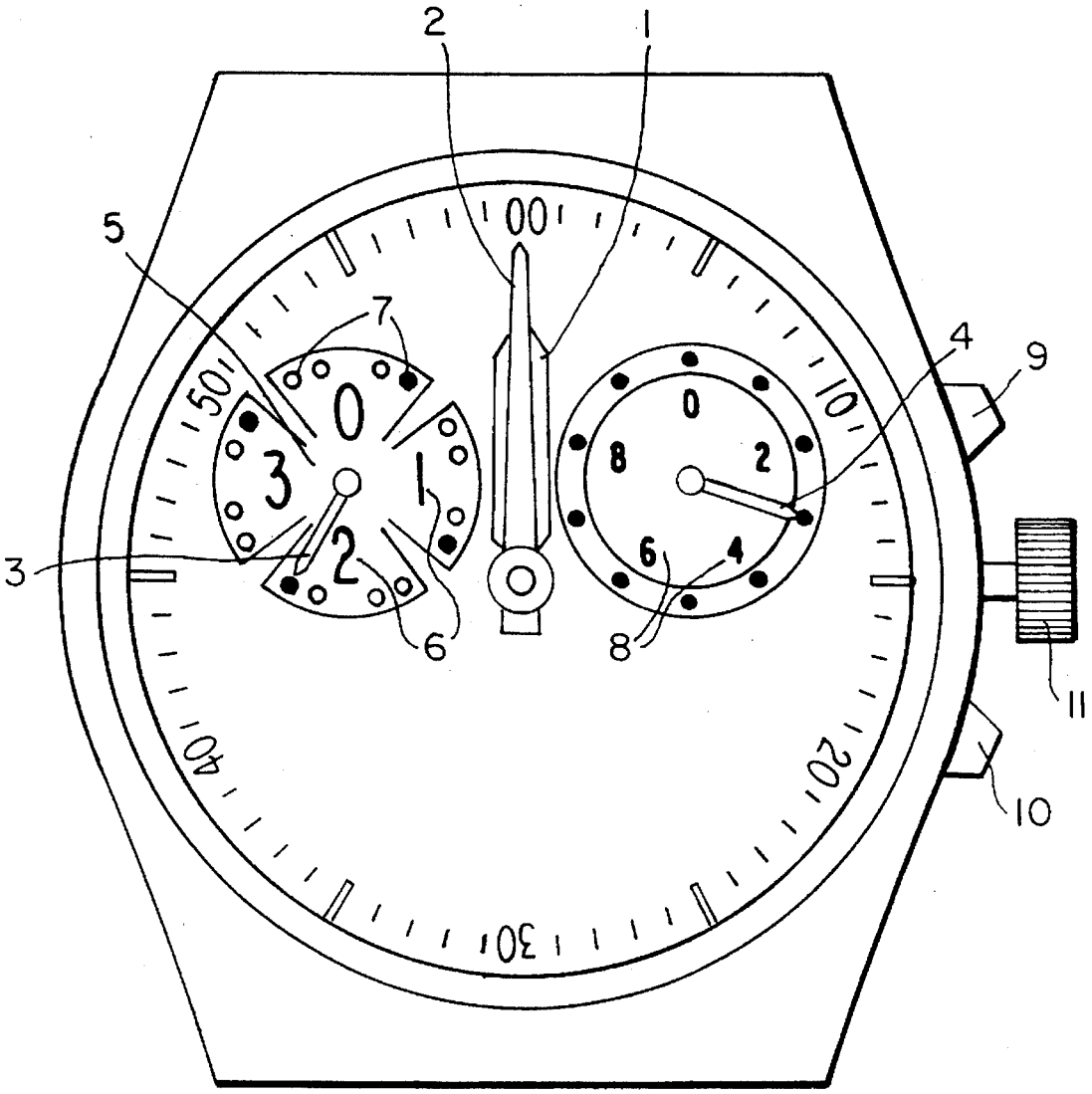
FIG. 1 shows by way of example a watch according to the invention with display of the day and leap year.

FIG. 1 shows by way of example a watch comprising hour hands (1) and minute hands (2) in addition to two hands (3 and 4) operating on two separate dials at 2 o'clock and at 10 o'clock to display the additional functions. These four hands are independent of each other and form as many display mobiles, each driven through a gear train by their own stepping motor, the position of each of these hands being governed directly by the electronic circuit.

In the configuration shown in FIG. 1, the hand (3) which makes 24 steps each turn, displays simultaneously the tens of the date and the leap year on one dial. This dial has a double scale formed by four segments numbered from 0 to 3 (6), each segment comprising an internal scale with four positions (7). The hand (3) thus indicates simultaneously the tens of the days in the corresponding segment, that is 2 in the case of FIG. 1, and the leap year in the internal scale of the segment. The hand (4) for its part indicates the units of the days on a scale of 0 to 9 (8). Thus, in the example in FIG. 1, the 23rd day of the month in a leap year is displayed. This particular design arrangement of the date display on two display mobiles allows a particularly accurate reading.

In order to proceed to the programming of a perpetual date, it is also necessary to be able to program the month. It is possible in the case of FIG. 1, to display temporarily the month by means of the hands (3 and 4) in the same way as the day, and to program the former by appropriate operation of the push-buttons (9 and 10). However, it may be useful to display simultaneously all the parameters in relation to the date, at the time of programming the latter.

This is possible in the case shown in FIG. 1, by placing the time adjusting stem (11) in an intermediate position. At this moment, the hour and minute hands (1 and 2) will display the month on the hour scale. This configuration permits the day, month and leap year to be displayed simultaneously as the date is being adjusted.

Details will not be provided of the electronic circuits associated with these functions, as these are already known, but we will concentrate on the display of the day, and the other complementary parameters on the two separate display mobiles, one for the tens and the other for the units.

Figure 2:
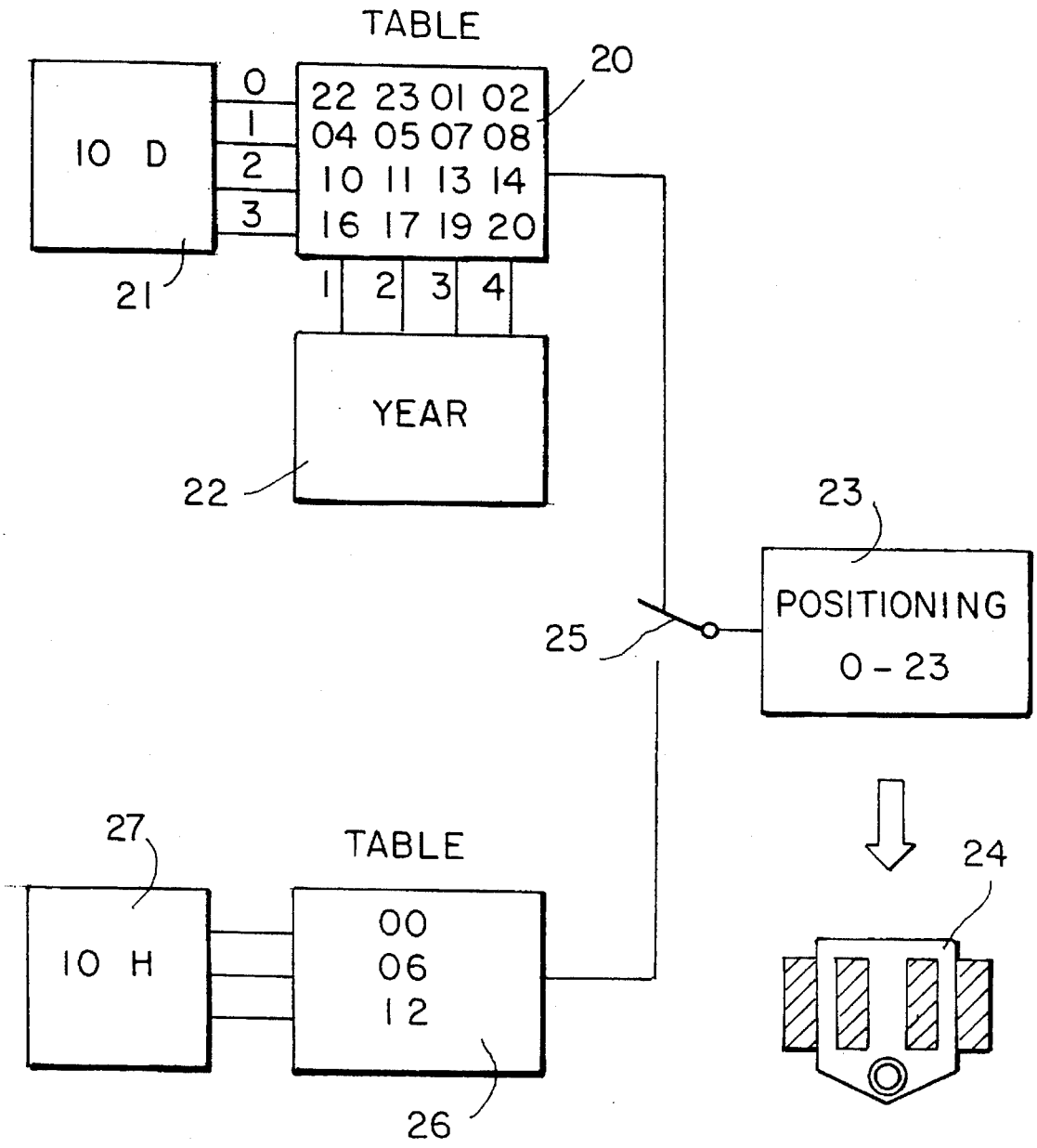
FIG. 2 shows schematically by way of example one part of the electronic means of a watch according to the invention.

FIG. 2 shows diagramatically by way of example the electronic circuit which governs the position of the hand (3). This circuit comprises a correlation table (20) connected on the one hand to a counting circuit of the tens of the day (21), and on the other hand to a counter of leap years (22). Each of these counters has four distinct states, which represents 16 possible combinations. The correlation table (20) therefore fixes 16 positions of the hand (3) corresponding to these 16 possible combinations, each of these 16 positions corresponding to a particular position of the hand on the dial (5). This correlation table is connected to a positioning circuit (23) which governs the 24 possible positions of the hand (3) on the dial and delivers the pulses to the motor (4) until the hand is in the position given by the correlation table.

It is very easy to use the hand (3) to display other parameters, such as, for example, the tens of the hours for the temporary display of the time in a 24 hour system. It is sufficient to connect the switch (25) to the output of a second correlation table (26) which is connected to the counter of the tens to the hour counter. We will see in FIG. 3 the use which can be made of this feature. Similarly, the switch could be used to connect the positioning circuit (23) to a third correlation table connected to the tens counter of the month counter, thus permitting the display of the tens of the month by means of the hand (3).

Figure 3:
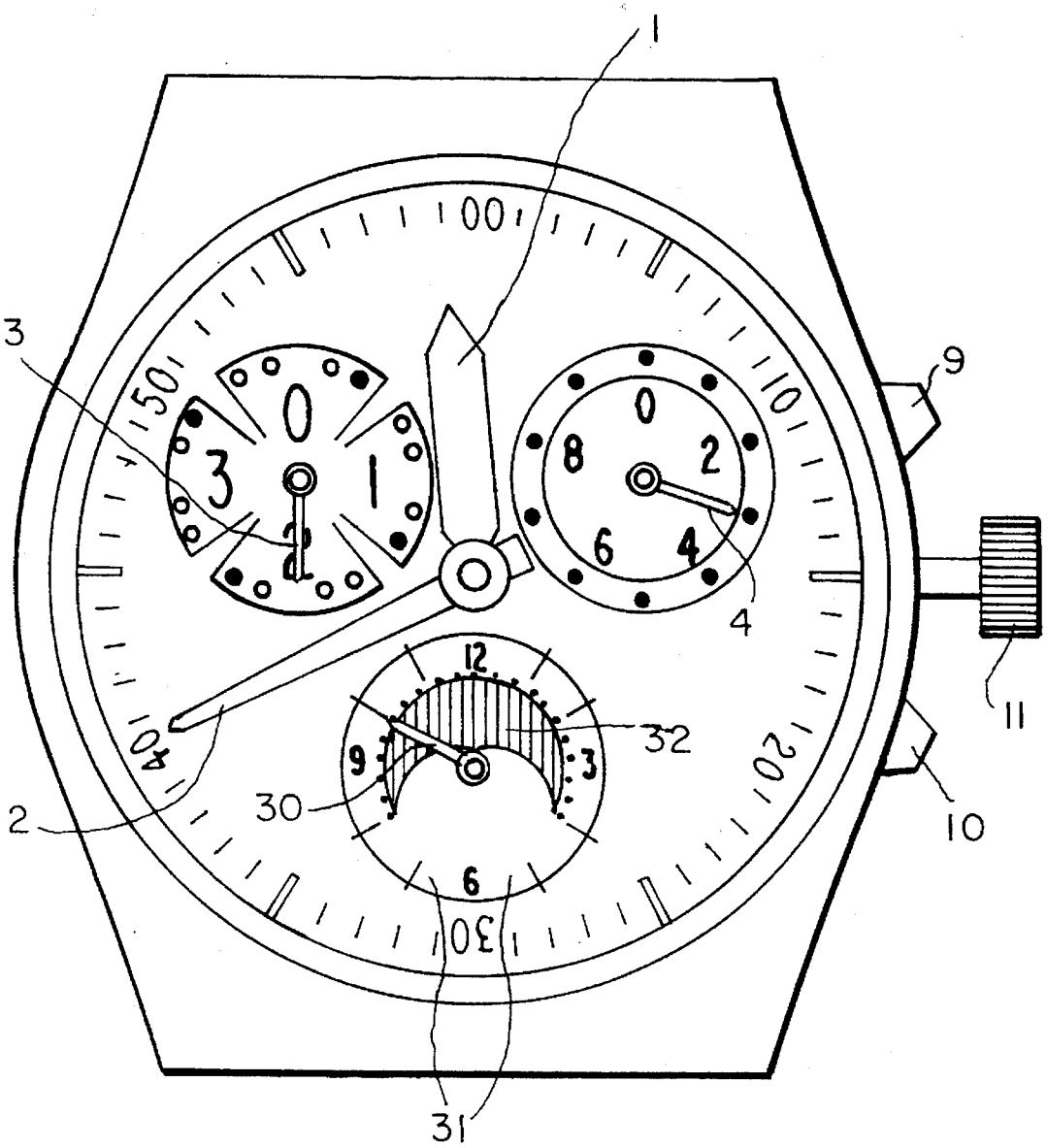
FIG. 3 shows by way of example a watch according to the invention to which displays of the month and phases of the moon have been added.

FIG. 3 illustrates by way of example a date dial whereby the month is permanently displayed by a supplementary display mobile comprising the hand (30) operating on a scale of 12 (31). This configuration allows all the parameters of a perpetual date to be displayed simultaneously, that is to say the units of the days by means of the hand (4), the tens of the days and the leap year by means of the hand (3), and the month by means of the hand (3). According to a similar configuration to that described in FIG. 2, it is possible to use the hand (30) to display temporarily a second parameter, that is to say, in the example in FIG. 3, the phases of the moon on the graphical element (32) intended to represent the vault of heaven.

As described in FIG. 2, it is possible to use the hands (3 and 4) to display temporarily another parameter in addition to the day. This concerns a display of a capacity of 00 to 39 which may be used to display any parameter situated between these limits.

The possibility of temporarily displaying the month when the date is being corrected has already been raised. FIG. 3 shows more specifically the case described in FIG. 2, that is to say the temporary display of the time in a 24 hour system when the time is being adjusted.

In FIG. 3, the time adjusting mechanism (11) is in the pulled-out position to allow the time shown by the hands (1 and 2) to be adjusted by means of the push-buttons (9 and 10). During this stage of adjusting the time, it is useful to display the time in a 24 hour system by means of the hands (3 and 4), that is to say, the tens by means of the hand (3) and the units by means of the hand (4), so as to avoid an error of 12 hours in the change over of the date, as frequently happens with classical watches. Thus, in FIG. 3, the hands (3 and 4) show 23 hours, it is therefore 23 h40 and not 11 h40.

Figure 4:
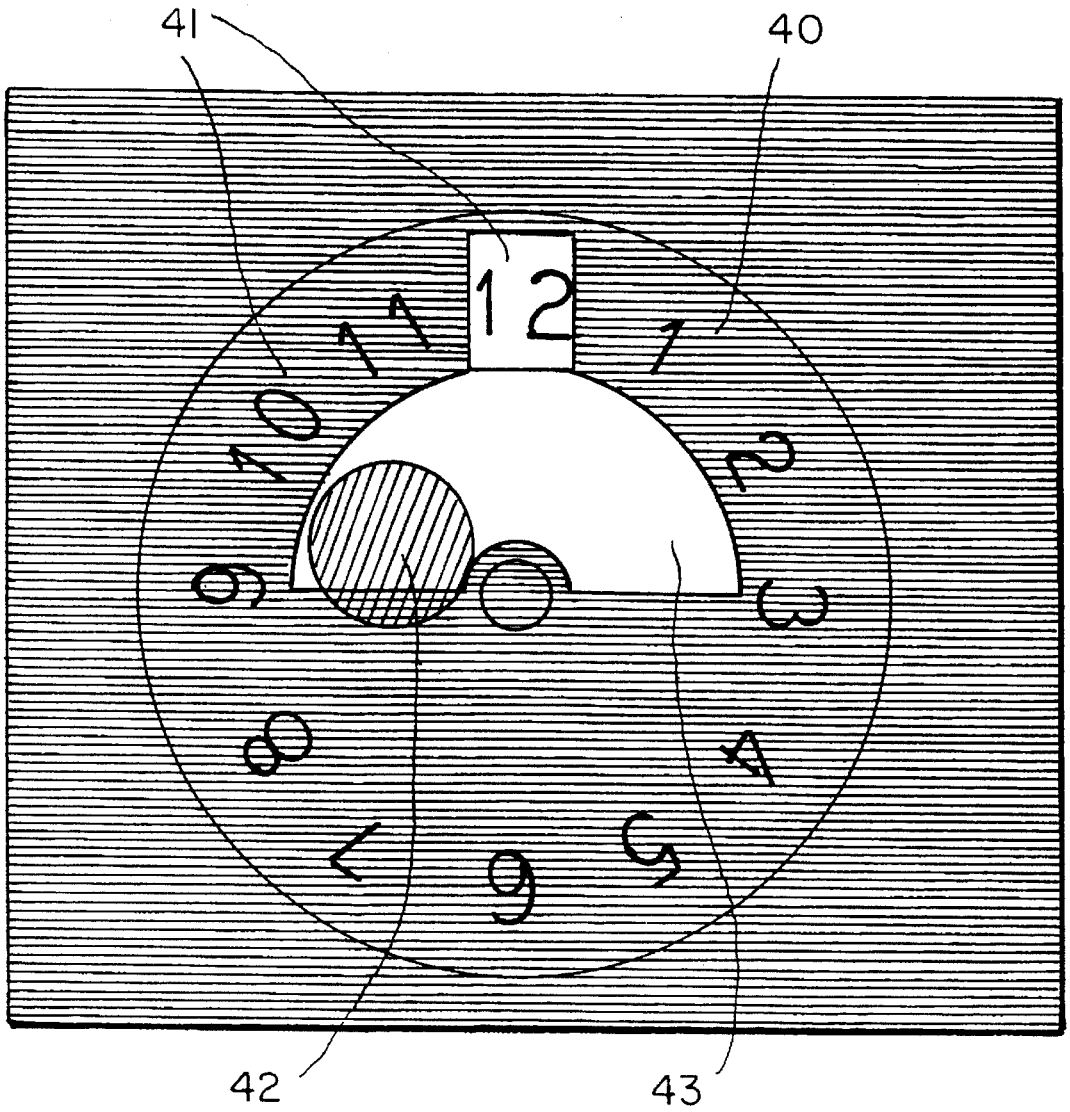
FIG. 4 shows by way of example a particular arrangement of a display mobile in which the hand has been replaced by a disc bearing a scale.

FIG. 4 shows a particular arrangement of a display mobile according to the invention. Indeed, in the claims, the term display mobile has been used rather than that of hand, because it is possible to replace the hand with other mobile systems, like for example a graduated disc which changes position in relation to fixed graphic elements. A transparent disc of this nature, comprising a scale of 1 to 12 (41) and a circle representing the moon (42) is shown in FIG. 4. This disc changes position on a dark background, which includes a light area (43). It should be noted that the indications facing the dark background are practically illegible, while the elements facing the light background are perfectly legible. This method allows interesting alternatives to be obtained and the month and even the day to be displayed in a pseudo-digital way.

It is obvious that many other combinations according to the invention are possible but a description of them would not add anything to an understanding of the invention.

What is claimed is:

1. A watch with date function comprising a plurality of display mobiles driven completely independently of each other by a plurality of stepping motors, characterised in that the watch comprises electronic means arranged in such a way as to display the date by means of two scales placed on two distinct dials, the tens of a month date being displayed on a first dial by a first of said display mobiles driven by a first motor, and the units of a month date being displayed on a second dial by a second of said display mobiles driven by a second motor; and in that the tens scale is combined with a scale of leap years, said electronic means being arranged in such a way that said first display mobile simultaneously displays the tens and the year.

2. A watch with date function comprising a plurality of display mobiles driven completely independently of each other by a plurality of stepping motors, characterised in that the watch comprises electronic means arranged in such a way as to display the date by means of two scales placed on two distinct dials, the tens of a month date being displayed on a first dial by a first of said display mobiles driven by a first motor, and the units of a month date being displayed on a second dial by a second of said display mobiles driven by a second motor; and in that the scale of the months is combined with a scale of the phases of the moon, said electronic means being arranged in such a way as to enable the month and phases of the moon to be displayed in turn by means of said third display mobile.

3. A watch with a date function, comprising:

a plurality of display mobiles; and electronic means comprising a plurality of driving means, for said display mobiles, and control means, for said driving means, which are arranged in such a way as to display the date by means of first and second distinct scales, the tens of the date of the month being displayed in connection with said first scale by a first of said display mobiles, and the units of the date of the month being displayed in connection with said second scale by a second of said display mobiles, wherein said first display mobile and said first scale are associated with a first dial, and said second display mobile and said second scale are associated with a second dial separate and independent from said first dial.

4. Analog watch according to claim 3, characterised in that said electronic means are arranged in such a way as to display the month on a third scale by a third of said display mobiles.

5. Analog watch according to claim 3, characterised in that said electronic means are arranged in such a way as to display temporarily the time in a 24 hour system when the time is being adjusted, the tens being displayed by said first display mobile and the units by said second display mobile.

6. Analog watch according to claim 3, characterised in that said electronic means are arranged in such a way as to display temporarily the month when the date is being adjusted, the tens being displayed by said first display mobile and the units by said second display mobile.

7. Analog watch according to claim 4, characterised in that at least one of said display mobiles comprises a mobile hand collaborating with a fixed scale.

8. Analog watch according to claim 4, characterised in that at least one of said display mobiles comprises a mobile disc bearing a scale.

* * * * *